US006626407B1

(12) United States Patent
Miller et al.

(10) Patent No.: US 6,626,407 B1
(45) Date of Patent: Sep. 30, 2003

(54) MOUNTING SYSTEM

(75) Inventors: Scott M. Miller, Kentwood, MI (US); Alan F. Mauer, Grand Rapids, MI (US)

(73) Assignee: Steelcase Development Inc., Grand Rapids, MI (US)

( * ) Notice: Subject to any disclaimer, the term of this patent is extended or adjusted under 35 U.S.C. 154(b) by 37 days.

(21) Appl. No.: 09/596,748

(22) Filed: Jun. 19, 2000

(51) Int. Cl.[7] ..... E06B 7/28

(52) U.S. Cl. ..... 248/250; 248/911; 248/912; 211/90.02; 211/192; 411/55; 411/58; 411/60.2

(58) Field of Search ..... 248/243, 246, 248/250, 911, 912; 411/55, 57.1, 60.2, 58; 211/103, 90.02, 192, 193

(56) References Cited

U.S. PATENT DOCUMENTS

| | | | | | |
|---|---|---|---|---|---|
| 941,682 | A | | 11/1909 | Knape | |
| 2,303,673 | A | | 12/1942 | Wilson | |
| 3,158,113 | A | * | 11/1964 | Johnson | 211/90.02 |
| 3,368,227 | A | | 2/1968 | Underdown, Jr. | |
| 4,154,419 | A | * | 5/1979 | Breidenbach | 248/243 |
| 4,182,004 | A | * | 1/1980 | Haring et al. | 452/187 |
| 4,884,371 | A | | 12/1989 | Gagnon | |
| 4,915,343 | A | * | 4/1990 | Terlecke | 411/58 |
| 5,116,007 | A | | 5/1992 | Von Gunton et al. | |
| 5,180,068 | A | * | 1/1993 | Vargo | 211/191 |
| 5,308,031 | A | * | 5/1994 | Evenson | 211/192 |
| 5,407,160 | A | * | 4/1995 | Hollingsworth et al. | 248/221.2 |
| 5,437,426 | A | | 8/1995 | MacDonald | |
| 5,699,944 | A | * | 12/1997 | Duran | 411/55 |
| 5,758,988 | A | * | 6/1998 | Theodorou | 211/192 |
| 5,855,347 | A | | 1/1999 | Hollingsworth et al. | |

* cited by examiner

*Primary Examiner*—Korie Chan

(57) ABSTRACT

A mounting system for use in a work environment is disclosed. The system includes a mounting bracket having a first side and a second side. Either side of the mounting bracket is adapted for selective coupling to one of a mounting structure or an accessory. The mounting system also includes a first mounting interface associated with the first side of the bracket and a second mounting interface associated with the second side of the bracket. A sub-interface extends from each of the first mounting interface and the second mounting interface comprising an expansion member configurable between a first effective average cross-sectional dimension and a second average effective cross-sectional dimension and adapted for receiving a fastener. A mounting bracket including a first side and a second side is also disclosed. The mounting bracket includes a first mounting interface associated with the first side of the mounting bracket and a second mounting interface associated with the second side of the mounting bracket. Either mounting interface of the mounting bracket is adapted for selective coupling to a mounting structure. The mounting bracket also includes a sub-interface for engaging an accessory and an expandable member adapted for receiving a fastener attached to the mounting bracket. A mounting system kit adapted for installation in a work environment is also disclosed. The kit includes a mounting structure an accessory and a mounting adapter. A method of using a mounting bracket is also disclosed.

24 Claims, 4 Drawing Sheets

FIG. 4
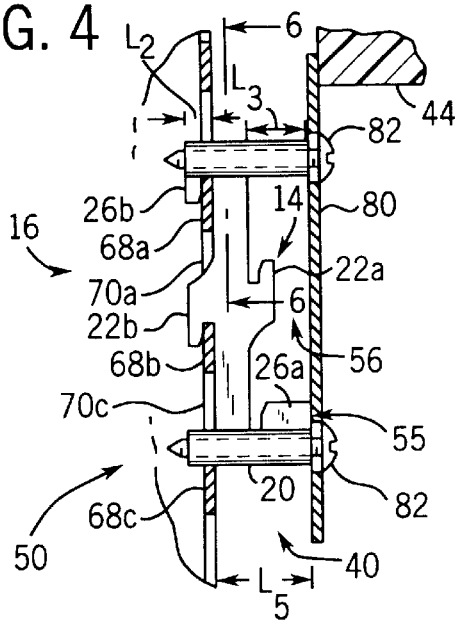
FIG. 5
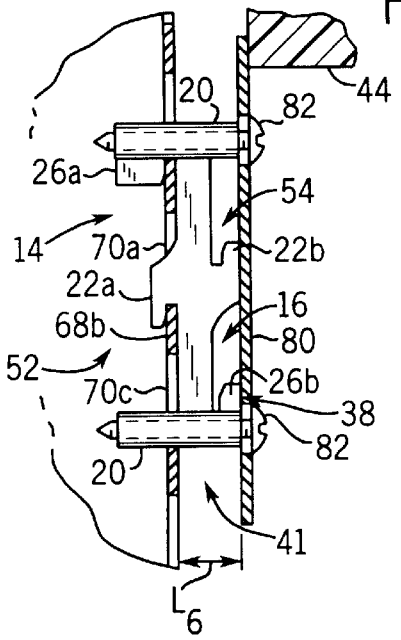
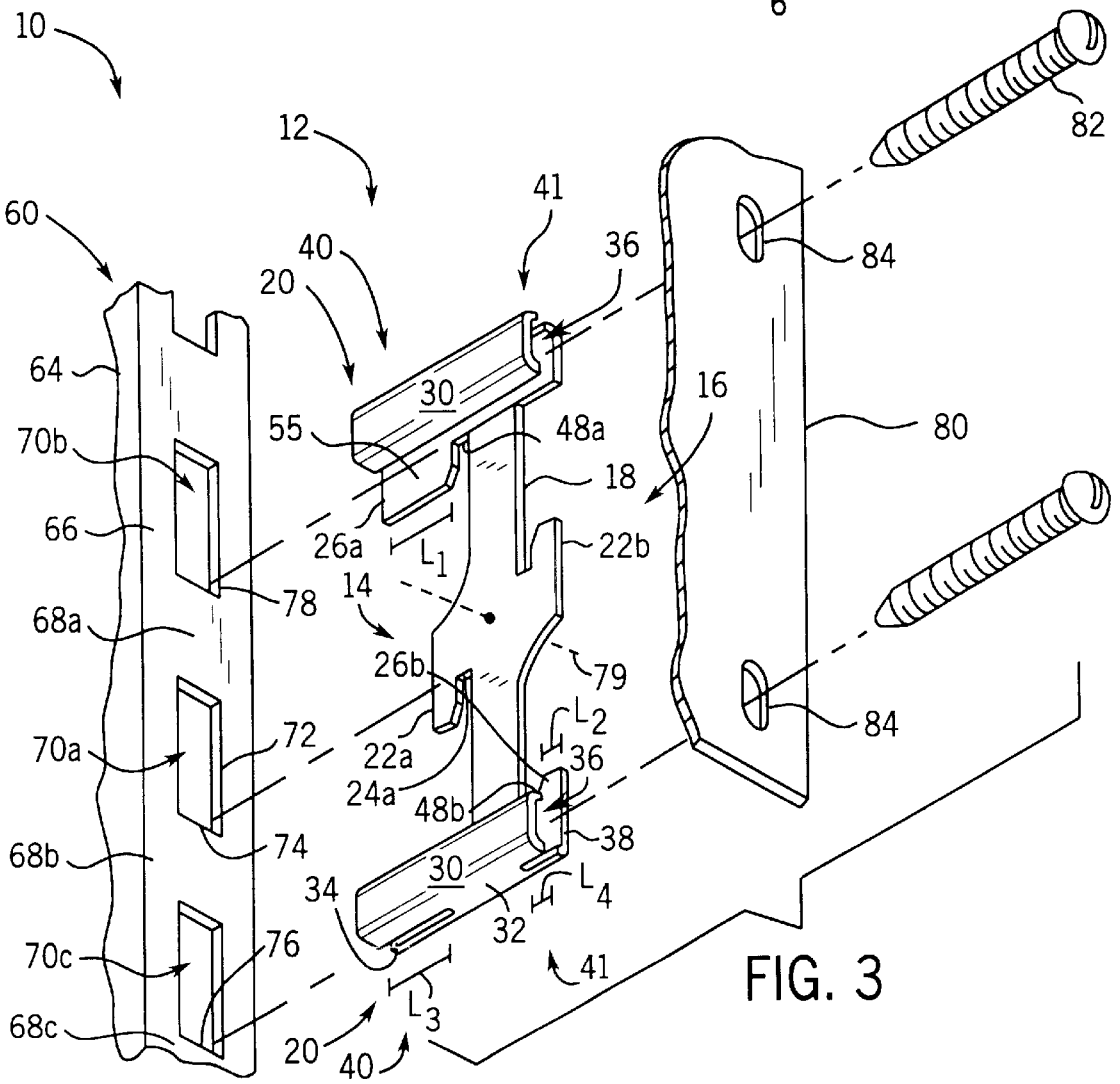
FIG. 3

MOUNTING SYSTEM

CROSS-REFERENCE TO RELATED APPLICATIONS

The following U.S. patents are cited by reference and incorporated by reference herein: U.S. Pat. No. 5.899,035 titled "KNOCK-DOWN PORTABLE PARTITION SYSTEM": U.S. Pat. No. 5,899,025 titled "FURNITURE SYSTEM".

FIELD OF THE INVENTION

The present invention generally relates to a mounting system for use in a work environment. In particular the present invention relates to a mounting bracket for coupling an accessory such as a worksurface to a mounting structure such as a frame of a partition wall system.

BACKGROUND OF THE INVENTION

It is known to provide a partition wall system for division of a work environment into individual or group spaces. Such partition wall system typically includes a panel section made of an internal rigid frame, typically made of a metal material. Exemplary partition wall systems include the Avenir®. Series 9000® and Answer® systems furniture commercially available from Steelcase Inc. Other exemplary partition wall systems are described in U.S. Pat. No. 5,899,035 titled "KNOCKDOWN-PORTABLE PARTITION SYSTEM" and U.S. Pat. No. 5,899,025 titled "FURNITURE SYSTEM", the disclosure of which are hereby incorporated by reference.

In such known partition wall systems, the frame typically includes parallel top and bottom members joined in a perpendicular arrangement with parallel side members (e.g., by common joining methods such as the use of fasteners or welding) in a "picture frame" or rectilinear configuration. (One or more cross members spanning between the top member and the bottom member may also be provided for support.) The frame may be "open" (e.g., having a central open space) or may be wholly or partially "filled" by a solid sheet of other material. An insert or covering panel "skin" or "tile", commonly referred to as a "cover panel", is typically installed on the frame. Two cover panels may be mounted to the frame in an abutting relationship to at least partially secure the frame from view. The skin may be provided with a decorative and/or functional surface treatment, and may be further covered by another laver (e.g., a functional or decorative fabric, covering, coating, etc.).

It is also known to provide an accessory that can be coupled or otherwise attached to the frame or frame members of the partition wall system. Such accessories can include worksurfaces, binder bins shelves e.g., for supporting miscellaneous materials such as books and files), display boards, lighting fixtures, pictures, information display systems, etc. Such accessories may provide for selective coupling of the accessory to the partition wall system, and are typically hung by a hanger from the frame or cover panel. However, such hanger is typically configured for use with only a single type of frame or a single type of cover panel. Further such hanger may only provide a relatively loose or insecure fit against the slit of the frame, which disadvantageously allows for relatively easy dislodgment of the accessory.

In order to overcome the problem of an insecure fit of an accessory, a conventional fastener such as a screw has been provided to attach the accessory to the partition wall system.

However, a problem with such screw is that it may permanently damage or deform the partition wall system by invasive attachment to the frame or cover panel.

Accordingly it would be advantageous to provide a mounting system that allows for secure attachment of an accessory to a frame of a partition wall system. It would also be advantageous to provide a mounting system adapted for use with multiple partition wall systems or multiple accessory configurations. It would also be advantageous to provide a mounting bracket that is "universal" or which may be installed in a variety of orientations to provide multiple mounting interfaces. It would also be advantageous to provide a mounting bracket that is relatively concealed from view when mounted to a frame of a partition wall system. It would also be advantageous to provide a unitary mounting bracket. It would further be advantageous to provide a mounting system including any one or more of these or other advantageous features.

SUMMARY OF THE INVENTION

The present invention relates to a mounting system for use in a work environment. The mounting system includes a mounting bracket including a first side and a second side. Either side of the mounting bracket is adapted for selective coupling to one of a mounting structure or an accessory. The mounting system also includes a first mounting interface associated with the first side of the bracket. The mounting system also includes a second mounting interface associated with the second side of the bracket. The mounting system also includes a sub-interface extending from each of the first mounting interface and the second mounting interface comprising an expansion member configurable between a first effective average cross-sectional dimension and a second average effective cross-sectional dimension and adapted for receiving a fastener.

The present invention also relates to a mounting system kit adapted for installation in a work environment. The kit includes a mounting structure. The kit also includes an accessory. The kit also includes a mounting adapter including a longitudinal base stem. The adapter also includes a first mounting interface and a second mounting interface extending from the base stem. Each of the first mounting interface and the second mounting interface are adapted for selective coupling to the mounting structure. The adapter also includes a sub-interface generally perpendicular to the base adapted for receiving a fastener and for coupling to both the mounting structure and the accessor.

The present invention also relates to a method of using a mounting bracket. The mounting bracket includes a first side and a second side. The mounting bracket also includes a first mounting interface associated with the first side of the mounting bracket and a second mounting interface associated with the second side of the mounting bracket. Either mounting interface of the mounting bracket is adapted for selective coupling to a mounting structure. The mounting bracket also includes a sub-interface for engaging an accessory and an expandable member adapted for receiving a fastener attached to the mounting bracket. The method includes attaching the first mounting interface of the mounting bracket to the mounting structure. The method also includes coupling the accessory to the sub-interface of the mounting bracket. The method also includes attaching a fastener to the accessory and inserting the fastener into the expandable member to the mounting bracket, thereby expanding a wall of the expandable member to engage a wall of the mounting structure and creating an interference fit between the expandable member and the mounting structure.

The present invention also relates to a mounting, bracket for use in a work environment. The mounting bracket includes a first mounting interface projecting from the stem adapted for selective attachment to a mounting structure. The mounting bracket also includes a sub-interface extending from either a terminal end or a distal end of the stem providing an expansion member configurable between a first effective diameter greater than a second effective diameter.

DESCRIPTION OF THE FIGURES

FIG. 3 is a fragmentary exploded perspective of a mounting system according to a preferred embodiment.

FIG. 4 is a fragmentary cross sectional view of the mounting system of FIG. 3 taken along line 4—4 to FIG. 2 installed according to one arrangement.

FIG. 5 is a cross sectional view of the mounting system of FIG. 3 installed according to another arrangement.

DETAILED DESCRIPTION OF PREFERRED AND OTHER EXEMPLARY EMBODIMENTS

Figure 1:
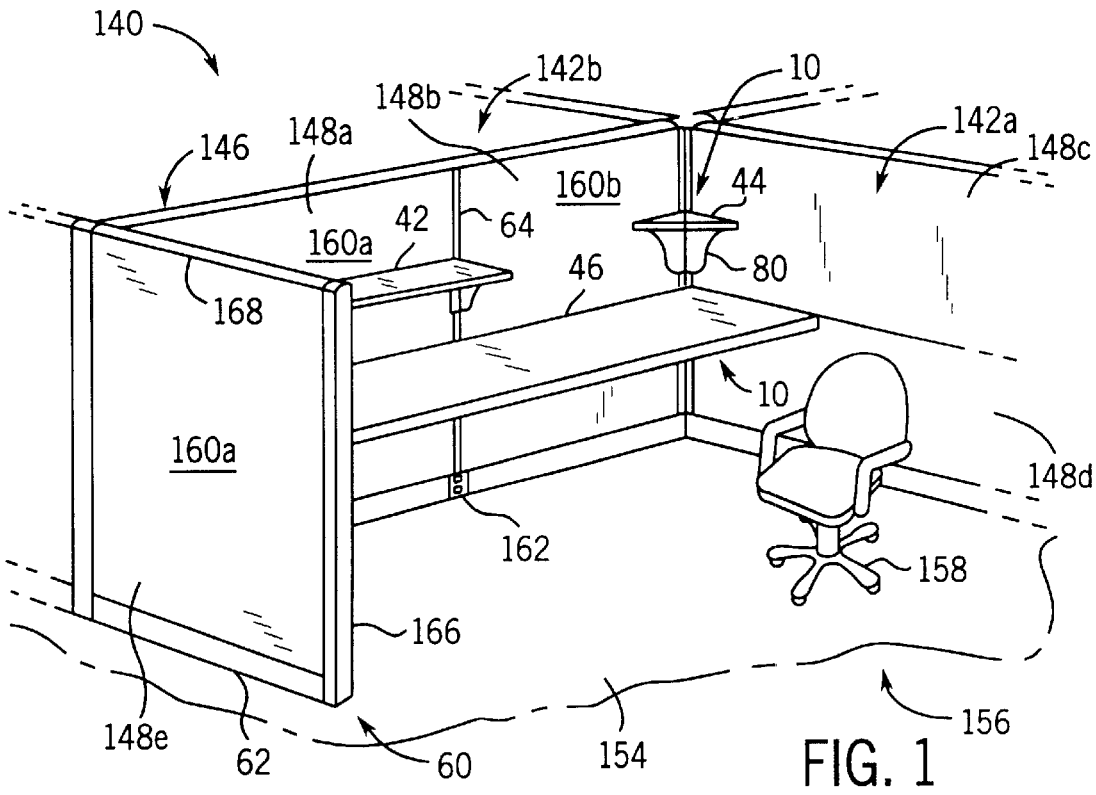
FIG. 1 is a fragmentary perspective view of a work environment including an accessory mounted to a partition wall system according to an exemplary embodiment.

Amounting system 10 is shown in FIG. 1. Mounting system 10 is useful for attaching an accessory (shown in FIG. 1 as a horizontal overhead shelf or ledge 42, a corner shelf 44, and a worksurface 46) to an internal support framework (shown as a frame 60) of a partition wall system 146 (see FIG. 3). Mounting system 10 includes a mounting bracket assembly or adapter (shown as a mounting clip 12 in FIG. 3). A first or major mounting interface 14 and a second or minor mounting interface 16 of clip 12 are configured for selective attachment to and removal from a mounting structure (shown as a vertical post 64). As shown in FIG. 4, major mounting interface 14 may be in a non-use position 56 when minor mounting interface 16 is attached to post 64.

A sub-interface expansion sleeve or barrel (shown as a spreader 20) of clip 12 includes a cylindrical tube (shown as a channel 36) for receiving a fastener (shown as a threaded screw 82). Spreader 20 is selectively expandable deformable or spreadable (e.g., by insertion of screw 82 within channel 36) for interaction or engagement with frame 60. Specifically the insertion of screw 82 may increase the external or effective diameter of channel 36, and removal of screw 82 may decrease the internal diameter of channel 36. Screw 82 selectively attaches the accessory to clip 12, and attaches clip 12 to post 64 without significant invasion or damage to post 64. Spreader 20 may have a second or minor average cross-sectional dimension (shown as a diameter $D_1$), which is less than a first or major average effective (cross-sectional dimension (shown as a diameter $D_1$) of slot 70*b*, which allows for entry of spreader 20 into slot 70*b* (see FIG. 10). The perimeter of spreader 20 may be expanded or deformed to an average effective cross-sectional dimension (shown as a diameter $D_2$), greater than dimension $D_1$ and substantially the same as dimension $D_2$, such that spreader 20 engages slot 70*b* of frame 60 (see FIG. 11).

Figure 10:
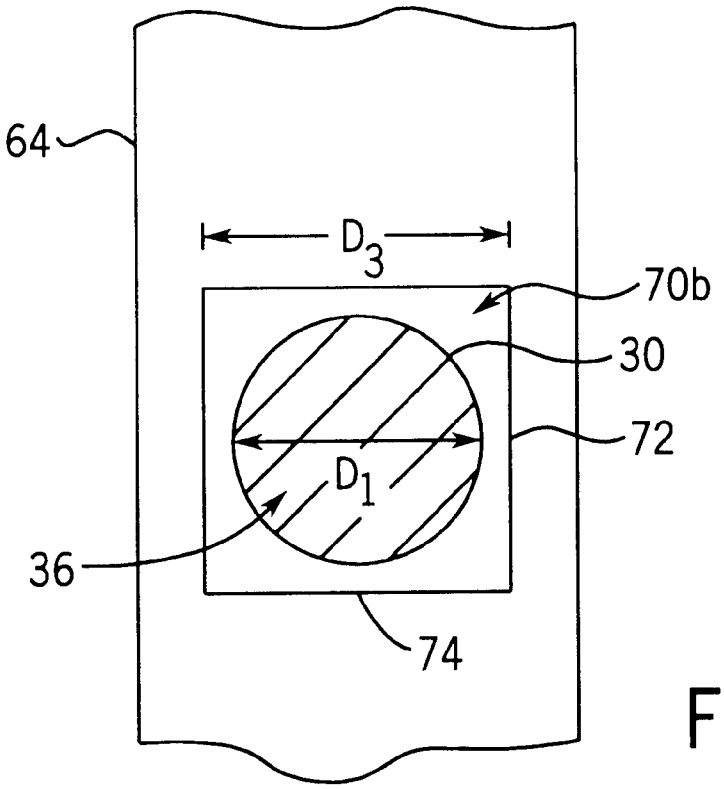
FIG. 10 is a sectional view of a sub-interface in a first position inserted in an aperture to a mounting structure.
Figure 11:
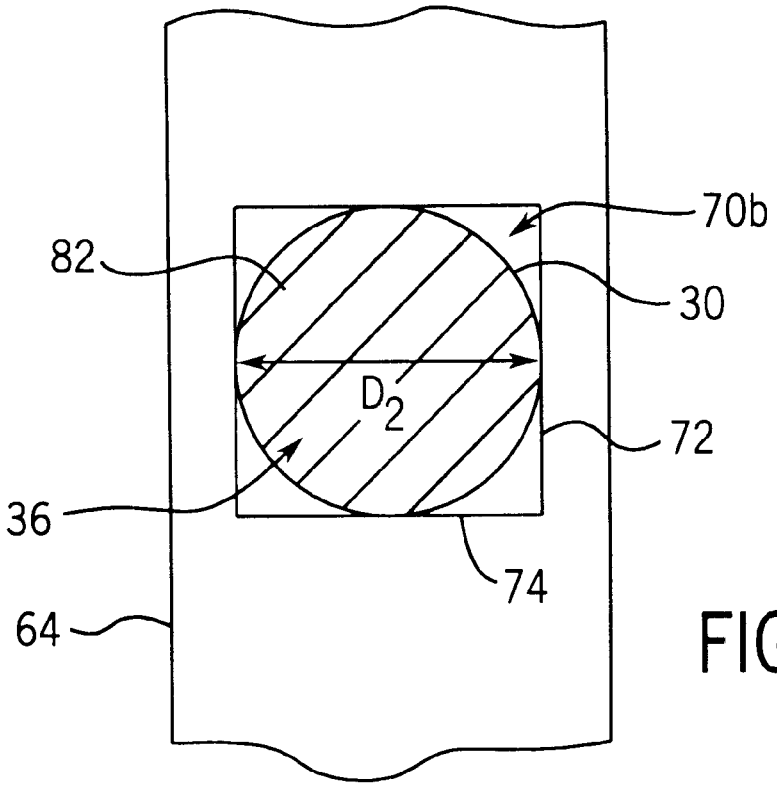
FIG. 11 is a sectional view of the sub-interlace of FIG. 10 in a second expanded position inserted in the aperture of the mounting structure shown in FIG. 10.

According to a suitable embodiment as shown in FIGS. 10 and 11. the average cross-sectional dimensional area of the spreader is selectively reconfigurable (e.g., by insertion and removal of the fastener) between the major average cross-sectional dimension and the minor average cross-sectional dimension. For example, the spreader may be made of a material that is deformable, and may have a structure that may be bent or activated to engage the slot of the mounting structure e.g., a wedge, a deformable perimeter, tumbler lock and key arrangement, etc.). The spreader may also include internal threads to selectively expand and contract the spreader on insertion or removable of a threaded fastener. The spreader may also be made of a "spring-like" or reformable material such that it bends to an original or default shape after removal of a fastener.

Referring to FIG. 1, wall system 146 is shown dividing a work environment 140 into multiple work areas (shown as a work area 142*a* and a work area 142*b*). Wall system 146 includes multiple panel sections interconnected both laterally (see e.g., panel sections 148*a* and 148*b*) and in a secure "stacked" fashion (see e.g., panel sections 148*c* and 148*d*). The panel sections may be of a partial height relative to a floor 154 (see e.g., panel section 148*d*), an intermediate height (see e.g., the height of panel section 148*a* compared to the height of panel section 148*d*), and a full height spanning from floor 154 to an overhead ceiling (not shown). Panel sections 148*a* through 148*e* are shown having a rectangular shape, but may be of any shape (e.g., curved, circular, triangular, etc.) according to alternative embodiments. An insert or covering panel (shown as a cover panel 160*a*) is shown attached to frame 60 of each of panel sections 148*a* through 148*e*, such that multiple panel sections and multiple skins surround work area 142*a*. An end cap 166 and a beam cap 168 may "frame" cover panel 160*a* and cover or shroud post 64. An opening or portal 156 (e g., door) spaced between adjacent panel sections 148*d* and 148*e* may provide worker access for ingress and egress to work area 142*a*.

Work area 142*a* may be provided with a variety of accessories mounted to wall system 146 to assist the workers in their daily tasks. For example: worksurface 46 is shown spanning across panel sections 148*a* and 148*b*; ledge 42 is shown extending outwardly from panel section 148*a*, and held up by a support brace 80 mounted to post 64; and shelf 44 is shown mounted to post 64 in a perpendicular orientation relative to each of panel sections 148*b* and 148*c*. The accessory may be of a variety of lengths, or mounted at a variety of heights relative to the panel section (e.g., compare the height of ledge 42 to worksurface 46). The accessory typically extends outwardly from the panel section as shown in a cantilevered arrangement in FIG. 1, but other mounting arrangements are possible (e.g., in a recessed alcove or "cubbie hole" of the work area, vertically aligned with a pinel selection, etc.). The accessory may be mounted to a frame corresponding to a single panel section (see e.g., the mounting arrangement of ledge 42 shown in FIG. 1) or spanning multiple panel sections (see e.g., the mounting arrangement of shelf 44 and worksurface 46 shown in FIG.

1). Multiple accessories may be used in combination to form a single structure (e.g., shelving unit, continuous ledge, cabinet series, etc.). Work area 142*a* may also be provided with other accessories. For example: an article of furniture such as a desk or seating product (shown as a task chair 158) is shown positioned for rolling movement along floor 154 in work area 142*a*, and storage units (e.g., overhead cabinet, and floor supported pedestal, etc.) may be attached or detached from wall system 146. A utility interface (shown as an electrical outlet 162) mounted to panel sections 148*a* and 148*b* may supply utility connections (e.g., voice, data, power, telephony, etc.) to work area 142*a*.

Frame 60 of wall system 146 provides numerous functions including a rigidifying or structural support for the panel sections, a structure for attaching cover panel 160*a*, and a structure for mounting the accessories. Frame 60 provides a horizontal beam 62 attached, such as by welding, to post 64 (i.e., typically in an "open", "picture frame" or rectilinear configuration). Post 64 includes a repeating arrangement of vertically aligned apertures or openings (shown as slots 70*a*, 70*b* and 70*c*). Each of the openings (i.e., slots) of post 64 are defined by a longitudinal upright 66 separated by separating webs or transverse rungs shown as rungs 68*a*, 68*b* and 68*c* (i.e., a rung separates two slots). Each slot is surrounded by a peripheral wall including a side wall 72 positioned perpendicularly to a base wall 74.

FIG. 5 shows major mounting interface 14 attached to post 64, and minor mounting interface 16 in a stabilization position 54. Major mounting interface 14 and minor mounting interface 16 are both integral with a longitudinal base (shown as a stem 18) of clip 12. A curved fastener or clasp (shown as finger shaped mounting hooks 22*a* and 22*b*) is integral with and extends from a central portion of stem 18. Hook 22*a* is associated with major mounting interface 14, and hook 22*b* is associated with minor mounting interface 16. The hooks are preferably sized for insertion within the slots of the frame. Each of hooks 22*a* and 22*b* define an interior indentation or notch (shown as a grove 24*a* and a groove 24*b*, respectively) for engaging a rung (e.g., rung 68*a* and rung 68*c*) of post 64. As shown in FIGS. 3 through 5, hook 22*a* is oriented in an opposite direction relative to hook 22*b*, such that hook 22*a* points or projects toward one spreader (i.e., a top spreader) and hook 22*b* points or projects toward another spreader (i.e., a bottom spreader). According to an alternative embodiment, the hooks may be oriented in the same direction (e.g., symmetrical). According to other alternative embodiments, one or more hooks may be included or omitted from the mounting clip.

A mounting flange or button, shown as a mounting tab 26*a* associated with the top spreader and a mounting tab 26*b* associated with the bottom spreader, extend from stem 18. (Tab 26*a* is associated with major mounting interface 14 and tab 26*b* is associated with minor mounting interface 16.) Each of tabs 26*a* and 26*b* also include a terminal end or wall 38 for abutting against brace 80. Tab 26*a* has a length $L_1$ typically greater than a length $L_2$ of tab 26*b*. The length of the tab determines in part whether the terminal wall of the tab may abut against the brace when the clip is mounted to the post. (See, for example, terminal wall 55 of tab 26*a* shown pressed against brace 80 in FIG. 4, and terminal wall 38 of tab 26*b* shown pressed against brace 80 in FIG. 5.) Tabs 26*a* and 26*b*, similar to respectively corresponding hooks 22*a* and 22*b*, each define an interior indentation or notch (shown as a groove 48*a* and a groove 48*b*, respectively) for engaging a rung of post 64. Tabs 26*a* and 26*b*, also similar to hooks 22*a* and 22*b* respectively, are oriented in an opposite direction relative to each other (i.e., tab 26*b* points or projects toward the one spreader (the top spreader) and tab 26*a* points or projects toward another spreader (the bottom spreader)). Hooks 22*a* and 22*b*, and tabs 26*a* and 26*b*, are all shown in the same plane and define a single planar strip or sheet of material. According to an alternative embodiment, the mounting clip may include multiple tabs of various widths (e.g., in a "symmetrical" arrangement) on the same or opposite sides of the stem).

Spreader 20 extends perpendicularly from an end of stem 18 (one top spreader and one bottom spreader are shown in FIG. 3). According to a preferred embodiment as shown in FIG. 3, spreader 20 may be a flared, rolled or turned lip of stem 18. Such rolling of stem 18 provides for simple manufacturing of clip 12 from a single sheet of material (e.g., sheet metal). A rim 30 of spreader 20, generally parallel to stem 18, is shown attached to stem 18 by a spine 32. Spine 32 may include a longitudinal gap 34 to assist in the "spreading" or expansion of spreader 20 during assembly and/or rolling or bending of stem 18 to form channel 36 of spreader 20. For example, only spine 32 need be bent during manufacturing, rather than the entire length of rim 30, which may create efficiencies during manufacture of clip 12. Rim 30 assists in forming channel 36 for receiving screw 82. Accordingly to a suitable embodiment as shown in FIGS. 10 and 11, the cylinder (i.e., channel) has a diameter less than a diameter of the fastener (i.e., screw), which attaches the accessory to the clip and the clip to the mounting structure. Spreader 20 also includes a first or major portion 40 having a length $L_2$ associated with major mounting interface 14, and a second or minor portion 41 having a length $L_1$ (typically less than length $L_3$) associated with minor mounting interface 16. Major portion 40 and minor portion 41 of clip 12 are each configured for insertion (in % hole or in part) within slots 70 of post 64 (see FIGS. 4 and 5).

Clip 12 is "reversible" and may be "flipped" (i.e., pivoted about 180 degrees relative to a pivot axis 79). Clip 12 may be positioned between at least one orientation (shown as a first arrangement 50 in FIGS. 3 and 5) for attachment of major mounting interface 14 to post 64. Clip may! also be positioned in at least another orientation (shown as a second arrangement 52 in FIG. 4) for attachment of minor mounting interface 16 to post 64. Thus, when major mounting interface 14 is attached to post 64 minor mounting interface 16 is in stabilization position 54 (see FIG. 5), and when minor mounting interface 16 is attached to post 64 major mounting interface 14 is in non-use position 56. In stabilization position 54, terminal wall 38 of tab 26*b* and hook 22*b* may abut or press against brace 80 and inhibit movement of brace 80 toward clip 12.

As shown in FIGS. 4 and 5, clip 12 is "universal" or capable of use with two or more types of panel wall systems or accessories. This is accomplished in part because clip 12 may provide two different depths for mounting shelf 44 (e.g., see a length $L_5$ compared to a length $L_6$) by modification of the position of clip 12 between first arrangement 50 and second arrangement 52. The orientation of clip 12 dictates in part the length or distance between post 64 and brace 80. For example, when clip 12 is installed in first arrangement 50, major portion 40 of spreader 20 projects or extends forward from post 64 a distance equal to length $L_5$ (see FIG. 4); and when clip 12 is installed in second arrangement 52, minor portion 41 of spreader projects or extends forward from post 64 a distance equal to length $L_6$, which is an amount typically less than length $L_5$ (see FIG. 5).

Figure 9:
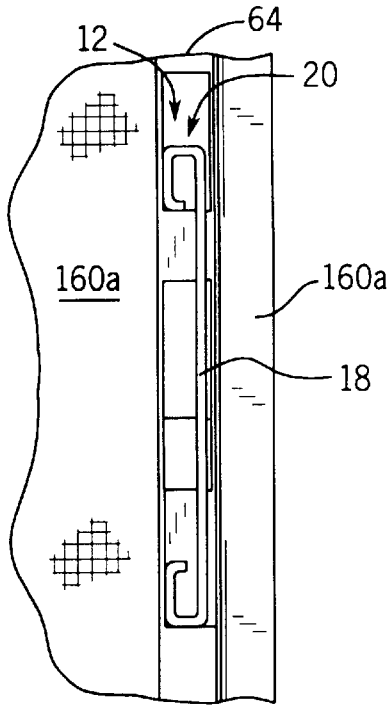
FIG. 9 is a fragmentary side elevation view of the mounting bracket to FIG. 3 installed in the partition wall system according to an exemplary embodiment.

According to a preferred embodiment, major portion 40 of spreader 20 may be wholly inserted within slot 70*c* so that stem 18 and minor portion 41 are outside of external to slot 70*c* when clip 12 is attached to post 64 in first arrangement 50. The desired type of partition wall system or accessory may dictate such different depths (e.g., compare length $L_5$ to length $L_6$). For example, clip 12 may be attached to post 64 in first arrangement 50 (as shown in FIG. 4) and shrouded (or at least partially visually concealed) on either or both sides by cover panels 160*a* and 160*b*, each having a thickness substantially equal to distance $L_5$ (see FIG. 9); and clip 12 may be attached to post 64 in second arrangement 52 (as shown in FIGS. 5 and 9) and shrouded on either or both sides by skins each having a thickness substantially equal to distance $L_5$, which is typically less than distance $L_5$. As shown in FIG. 9 clip 12 may be positioned or nested between cover panel 160*a* and cover panel 160*b* so that spreader 20 is flush with or positioned behind the skins. Thus, clip 12 is shrouded or at least partially concealed from side view by the abutting ends of cover panels 160*a* and 160*b* which may be positioned in a end-to-end relationship.

An accessory may be selectively installed or removed from wall system 146 according to the following method (see FIG. 5). To install or attach clip 12 to post 64, hook 22*a* is inserted into slot 70*a* of post 64. A downward force is applied to clip 12 such that groove 24*a* is supported by and placed in engagement with base wall 74 of rung 68*b*. Hook 22*a* is preferably attached at a midpoint 76 of rung 68*b*. Tab 26*a* is inserted into slot 70*b* of post 64 such that groove 48*a* is supported by rung 68*a* when the downward force is applied to clip 12. When so mounted, tab 26*a* preferably abuts against side wall 72 of slot 70*a* at an endpoint of slot 70*a*. During mounting, the top spreader is also inserted into slot 70*b* (e.g., substantially simultaneously with the insertion of the bottom spreader in the slot). (The bottom spreader is also inserted into slot 70*c* such that spine 32 abuts against rung 68*c*.) Thus, clip 12 in second arrangement 52 may be "locked" or fixed in place by at least the following mounting points or locations: (1) by groove 24*a* of hook 22*a* against base wall 74 of rung 68*b*; (2) by groove 48*a* of tab 26*a* against base wall 74 of rung 68*a*; and (3) by engagement of the top spreader with rung 68*a* and the bottom spreader with rung 68*c* (two spreaders are shown in pressed against side wall 72 of post 64 in FIG. 5). The attachment and alignment of minor mounting interface 16 to post 64 is similar to the attachment and alignment of major mounting interface 14 to post 64. Specifically, by insertion of hook 22*b* into slot 70*a*, by insertion of tab 26*b* and a spreader into slot 70*b*, and by insertion of a spreader into slot 70*c* (see FIG. 4).

Brace 80 may be attached to clip 12, whether clip 12 is in first arrangement 50 or second arrangement 52 according to the following method (see FIG. 3). To attach brace 80 to clip 12, brace 80 is brought into contact with spreader 20 of clip 12 and an aperture (shown as a hole 84 in FIG. 3) of brace 80 is aligned with channel 36 of spreader 20. Hook 22*a* is inserted into slot 70*a* of post 64 and the top and bottom spreaders are inserted into the corresponding slots of post 64 (see FIG. 5). Screw 82 is inserted into the apertures of brace 80 and channel 36 of spreader 20. The insertion of screw 82 tends to expand the diameter or effective area of channel 36 (e.g., by flexing or bending of spine 32) such that rim 30 is brought into frictional contact with side wall 72 to form a relatively tight, interference fit (see FIG. 8). Such insertion of screw 82 and expansion of spreader 20 assists in inhibiting brace 80 from becoming relatively easily dislodged from post 64. Screw 82 may be subsequently removed from spreader 20, and clip 12 may be removed or detached from post 64 for quick and easy replacement, repair and/or reconfiguration of work area 142*a*.

Figure 2:
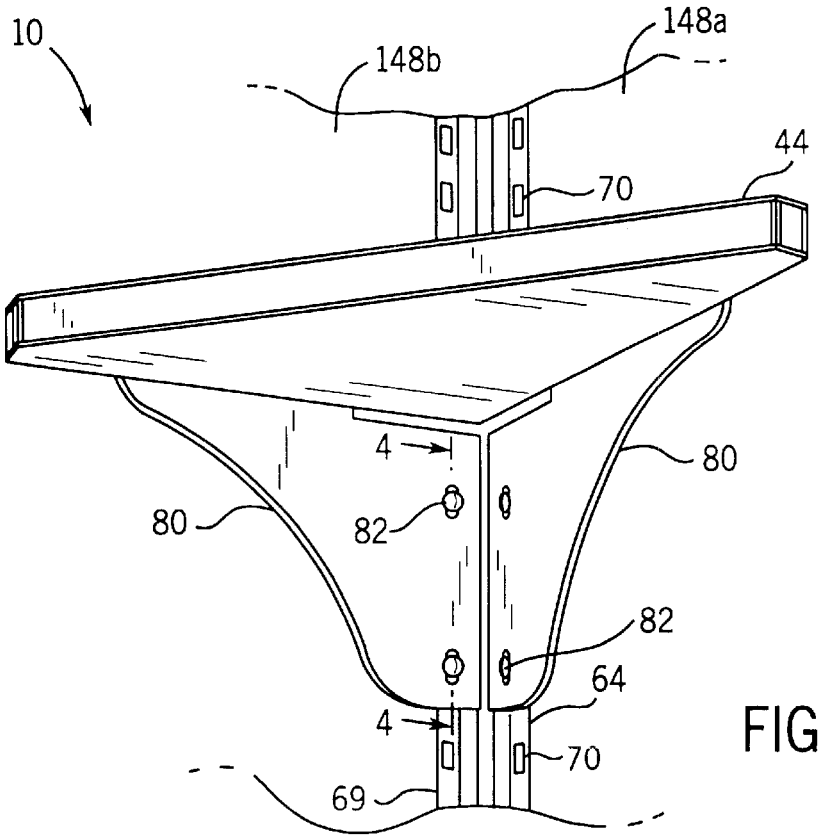
FIG. 2 is a fragmentary perspective view of an accessory mounted to the partition wall system to FIG. 1.
Figure 6:
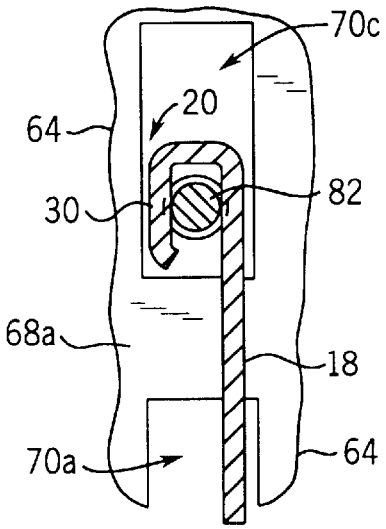
FIG. 6 is a fragmentary cross-sectional view of the mounting system taken along line 6—6 of FIG. 4.

Brace 80 is shown in FIG. 2 having an overall triangular-shape with a contoured side or leg. A relatively linear top edge or leg of brace 80 includes a recessed slot or gap portion for selective positioning or movement (e.g., shock absorption) of shelf 44. A major portion of the top edge of brace 80 supports an underside of shelf 44 so that shelf 44 may be positioned parallel with floor 144. The brace may have any of a variety of shapes and structures to support the accessory and to receive the fastener for coupling the brace to the clip. As shown in FIGS. 1 and 2, multiple clips may support any one brace or accessory.

Figure 7:
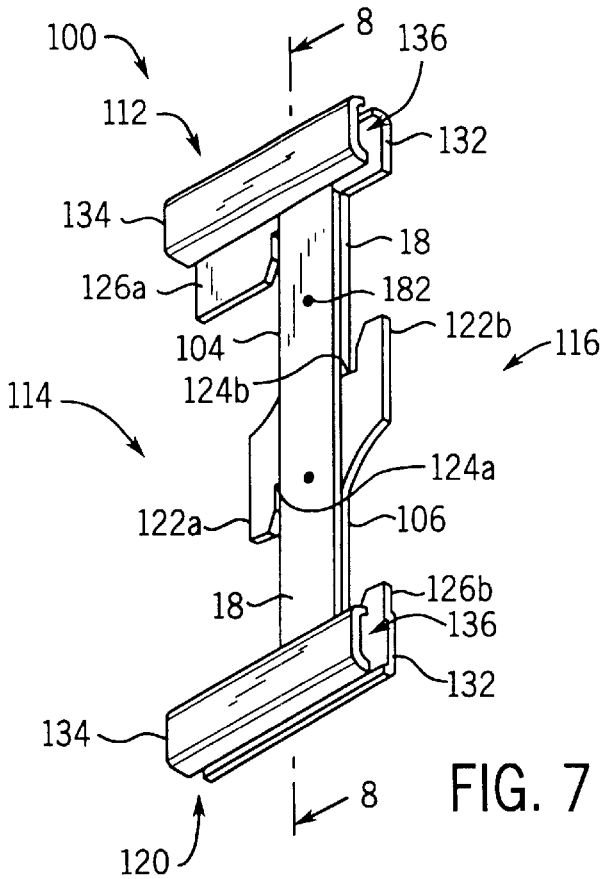
FIG. 7 is a perspective view of a mounting bracket according to an alternative embodiment.

FIG. 7 shows a perspective view of a mounting clip 112, an alternative embodiment of clip 12. Clip 12 differs from clip 12 in certain respects: clip 112 does not include spine 32; the structure of spreader 120 has been modified from spreader 20; and clip 112 is formed from a base piece 104 attached to a cover piece 106. Other than these differences, the construction, performance aid function of clip 112 is substantially the same as clip 12, and like reference numerals are used to identify like elements.

A base wall 134 of clip 112 extends perpendicularly from stem 18 of base piece 104, and a cover all 132 extends perpendicularly from stem 18 of cover piece 106. A track or channel 136 is disposed between base wall 134 and cover wall 132 to form spreader 120, similar to spreader 20, for receiving screw 82. Hook 122*a* and hook 122*b* of clip 112, similar to hooks 22*a* and 22*b*, extend in opposite directions from a central portion of cover piece 106 of spreader 120. Tab 126*a* and tab 126*b* of clip 112, similar to tabs 26*a* and 26*b*, are shown extending in opposite directions from a central portion of cover piece 106 of spreader 120. A fastener (shown as a spot weld 182) attaches base piece 104 to cover piece 106. According to an alternative embodiment, one hook or tab may extend from the cover piece and another hook may extend from the base piece (and vice-versa). According to other alternative embodiments, one or more hooks or tabs may be oriented in a variety of directions or may be omitted.

Figure 8:
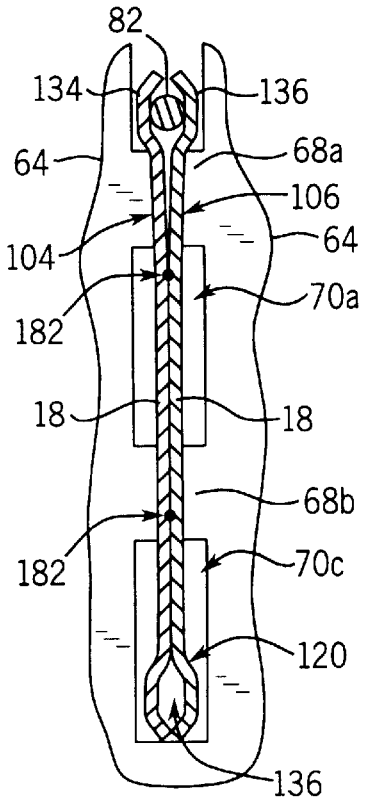
FIG. 8 is a cross-sectional view of the mounting bracket of FIG. 7 taken along line 8—8 of FIG. 7.

Clip 112 includes a first or major mounting interface 114 and a second or minor mounting interface 116, either of which may be attached to post 64 in a similar method of attachment of clip 12 to post 64. When screw 82 is inserted into channel 136, base wall 134 and cover wall 132 of spreader 120 are spread, drawn or urged apart from each other (see FIG. 8). (Base piece 104 and cover piece 106 may also be slightly urged apart from each other as shown in FIG. 8.) Such urging apart of base wall 134 and cover wall 132 brings base wall 134 and cover wall 132 into a press fit or interference relationship with side wall 72 of the slots of post 64. (Compare spreader 120 shown in FIG. 8 with inserted screw 82 to spreader 120 in FIG. 8 showing the fastener or screw yet to be inserted.)

According to a particularly preferred embodiment, the mounting bracket is made of carbon steel. The stem preferably has a length of about 2.25 inch measured from spreader to spreader, and a width of about 0.85 inch measured from one end of the spreader to the other end of the same spreader. The stem preferably has a width of about 0.425 inch immediately adjacent the spreader, and a width of about 0.250 inch measured from the hook of the first mounting interface to the hook of the second mounting interface. The hook preferably extends from the stem about 0.19 inch and the tabs extend from the spreader about 0.425 inch. The grooves or notches of the hooks preferably have a width of about 0.075 inch. The diameter of the spreader is in the range of about 0.10–0.246 inch. The clip preferably has a weight in the range of about 0.06–0.20 lbs. The shape of the spreader is preferably hexagonal shaped.

It is important to note that positional terms such as "top" and "bottom" are not intended to restrict the arrangement of the mounting system to any one arrangement, orientation or configuration. Indeed, the mounting clip is "reversible" so that a "top" element (e.g., spreader) may also be a "bottom" element (e.g., spreader). It is also important to note that relative terms such as "major" and "minor" are not intended to restrict the arrangement, structure or configuration of the mounting system. Indeed, the major mounting interface may be substantially the same size or configuration of the minor mounting interface.

It is also important to note that the construction and arrangement of the elements of the mounting system described in the exemplary embodiments is illustrative only. Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, use of materials, orientations, colors, combinations of shapes, etc.) without materially departing from the novel teachings and advantages of the invention. For example, the mounting system may be used with any of variety of proprietary or commercially available partition wall systems or mounting structures (such as a poster or mounting rack). The mounting clip may be symmetrical (e.g., having one mounting interface structure substantially identical to another mounting interface). The mounting clip may include a single mounting interface, or may be "reversible" and include more than one mounting interface. The mounting clip may include a single sub-interface (e.g., sleeve or spreader) or multiple spreaders (e.g., the mounting clips are shown with two spreaders in the FIGURES). The tabs of the mounting clip may abut or press against the brace to provide support, and do not necessarily need to engage the brace. The hooks of the mounting clip may include a fastener or threaded projection for attachment to an accessory. The hooks may be omitted altogether, depending in part of the load provided by the accessory, such that the spreader(s) and/or tab(s) (if any) may engage the frame to support the accessory. The mounting clip may include any variety of "branching" or attachment mechanism for mounting to the accessory or the frame. The mounting clip may be made of any variety or combinations of materials (e.g., plastic, carbon steel, sheet metal, aluminum, etc.). The mounting clip may be provided with a variety of decorative surface treatments such as colored paint. The vertical post of the frame may provided with any number of apertures spaced apart at a variety of distances. The mounting clip may engage any of the apertures of the vertical post. The apertures of the post may be any of a variety of shapes (e.g., square, oval, curved, slit, random, etc.). The clip may be mounted to a horizontal beam having a pattern of horizontal slots (e.g., the clip may be oriented in a horizontal or cantilevered orientation relative to the frame). Further, it is readily apparent that panel sections and cover panels can be made in any of a wide variety of shapes, sizes and thickness, with a wide variety of weights and strengths, and can be incorporated into a wide variety of partition wall systems with a wide variety of types of coverings cover panels or interconnections and cable management arrangements. The clip may be used in any environment including a home, workshop, dealer space, etc. Accordingly, all such modifications are intended to be included within the scope of the invention as defined in the appended claims.

What is claimed is:

1. A system for coupling an accessory to a mounting structure comprising:

a mounting bracket comprising:

a first interface comprising a projection and a hook having a first mounting surface for coupling to the accessory, the first interface configured for selective coupling to one of the mounting structure and the accessory;

a second interface configured for selective coupling to one of the mounting structure and the accessory and having a second mounting surface;

wherein when the mounting bracket is in a first position:

the first interface is adapted for coupling to the mounting structure;

the second interface is adapted for coupling to the accessory; and the mounting bracket is adapted for coupling to the accessory to provide a first horizontal distance between the first mounting surface and the accessory;

wherein when the mounting bracket is in a second position:

the first interface is adapted for coupling to the accessory;

the second interface is adapted for coupling to the mounting structure; and the mounting bracket is adapted for coupling to the accessory to provide a second horizontal distance between the first mounting surface and the accessory less than the first horizontal distance.

2. The system of claim 1 wherein the mounting bracket in the first position is adapted for at least partial insertion to a first depth within the mounting structure and the mounting bracket in the second position is adapted for at least partial insertion to a second depth within the mounting structure.

3. The system of claim 1 wherein the second position of the mounting bracket is a reversed position relative to the first position.

4. The system of claim 3 wherein the mounting bracket is adapted to be pivoted about one-hundred and eighty degrees between the first position and the second position relative to the mounting structure.

5. The system of claim 1 wherein the first interface is configured for removable coupling to the mounting structure and the accessory.

6. A system for coupling an accessory to a mounting structure comprising:

a mounting bracket comprising:

a first interface comprising a projection and a hook, the first interface configured for selective coupling to one of the mounting structure and the accessory;

a second interface configured for selective coupling to one of the mounting structure and the accessory;

a member for expansion by a fastener;

wherein when the mounting bracket is in a first position:

the first interface is adapted for coupling to the mounting structure;

the second interface is adapted for coupling to the accessory; and the mounting bracket is adapted for coupling to the accessory to provide a first distance from the mounting structure to the accessory;

wherein when the mounting bracket is in a second position:

the first interface is adapted for coupling to the accessory;

the second interface is adapted for coupling to the mounting structure; and the mounting bracket is adapted for coupling to the accessory to provide a second distance from the mounting structure to the accessory.

7. The system of claim 6 wherein the hook comprises a mounting surface for coupling to the accessory.

8. The system of claim 6 wherein the mounting bracket in the first position is adapted for at least partial insertion to a first depth within the mounting structure and the mounting bracket in the second position is adapted for at least partial insertion to a second depth within the mounting structure.

9. A system for coupling an accessory to a mounting structure comprising:

a mounting bracket comprising:

first means comprising a plurality of hooks configured for selective coupling to one of the mounting structure and the accessory;

second means comprising a plurality of hooks, wherein at least one of the plurality of hooks of the second means are configured for selective coupling to one of the mounting structure and the accessory;

wherein when the mounting bracket is in a first position the first means are adapted for coupling to the mounting structure and at least one of the plurality of hooks of the second means is adapted for coupling to the accessory, and when the mounting bracket is in a second position the first means is adapted for coupling to the accessory and the second means is adapted for coupling to the mounting structure.

10. The system of claim 9 wherein the first means further comprises a tab.

11. The system of claim 10 wherein the tab is adapted for coupling to the accessory when the mounting bracket is in the second position.

12. The system of claim 9 further comprising third means for selective coupling to the mounting structure and the accessory.

13. The system of claim 12 wherein the third means for selective coupling comprises a sleeve.

14. The system of claim 13 wherein the sleeve is configured to engage the mounting structure by insertion of a fastener.

15. A system adapted for use in a work environment comprising:

a mounting structure;

an accessory;

a mounting bracket including:

a first hook configured for coupling to the mounting structure;

a second hook opposite the first hook and configured for coupling to the mounting structure;

a first projection coupled to the first hook;

a second projection coupled to the second hook;

wherein when the mounting bracket is in a first position:

the first hook is adapted for coupling to the mounting structure; and the mounting bracket is adapted for coupling to the accessory to provide a first distance between the mounting structure and the accessory;

wherein when the mounting bracket is in a second position:

the second hook is adapted for coupling to the mounting structure;

the first projection is adapted for coupling to the accessory; and the mounting bracket is adapted for coupling to the accessory to provide a second distance between the mounting structure and the accessory less than the first distance.

16. The system of claim 15 wherein the first projection is inserted a first depth into the mounting structure when the mounting bracket is in the first position and the second projection is inserted a second depth into the mounting structure when the bracket is in the second position.

17. The system of claim 15 wherein the second position of the mounting bracket is a reversed position relative to the first position.

18. The system of claim 17 wherein the mounting bracket is adapted to be pivoted one hundred and eighty degrees between the first position and the second position relative to the mounting structure.

19. A system adapted for use in a work environment comprising:

a mounting structure;

an accessory;

a mounting bracket including:

a first hook configured for coupling to the mounting structure;

a second hook opposite the first hook and configured for coupling to the mounting structure;

a first projection coupled to the first hook;

a second projection coupled to the second hook;

a member for expansion by a fastener;

a wherein when the mounting bracket is in a first position:

the first hook is adapted for coupling to the mounting structure; and the mounting bracket is adapted for coupling to the accessory to provide a first distance from the mounting structure to the accessory;

wherein when the mounting bracket is in a second position:

the second hook is adapted for coupling to the mounting structure and the first projection is adapted for coupling to the accessory; and the mounting bracket is adapted for coupling to the accessory to provide a second distance from the mounting structure to the accessory.

20. The system of claim 19 wherein the member comprises a sleeve.

21. The system of claim 19 wherein the mounting structure comprises a vertical post having a plurality of vertical mounting slots.

22. The system of claim 19 wherein the accessory comprises a panel covering.

23. The system of claim 19 wherein the first projection is adapted for insertion to a first depth into the mounting structure when the mounting bracket is in the first position and the second projection is adapted for insertion to a second depth into the mounting structure when the bracket is in the second position.

24. The system of claim 19 wherein a space is provided between the second hook and the accessory when the mounting bracket is in the first position.

* * * * *